United States Patent [19]

Runberg et al.

[11] 3,963,034

[45] June 15, 1976

[54] MAKE UP GUARD

[76] Inventors: Richard K. Runberg; Shirley M. Runberg, both of 391 Ironpike Circle, Anaheim, Calif. 92807

[22] Filed: Jan. 31, 1975

[21] Appl. No.: 546,007

[52] U.S. Cl. ..... 132/9; 2/9

[51] Int. Cl.[2] ..... A45D 4/18

[58] Field of Search ..... 132/9, 79; 2/9, 2.1 R, 2/2.1 A, 14 H, 14 J, 14 K, 14 N; 128/146

[56] References Cited

UNITED STATES PATENTS

| | | | |
|---|---|---|---|
| 3,060,445 | 10/1962 | Brockman | 2/9 |
| 3,317,921 | 5/1967 | Zarzour | 2/9 |

*Primary Examiner*—G.E. McNeill

*Attorney, Agent, or Firm*—William C. Babcock

[57] ABSTRACT

A flat transparent sheet of a polymerized resin in the form of a paddle that may be wrapped circumferentially about a container that holds an aerosol type hair spray. The paddle has a number of spaced score lines so arranged thereon that after the sheet is removed from the container, and the longitudinal edges of the handle pressed towards one another, the handle will assume a generally channel shaped transverse cross section. As the handle assumes this channel shaped transverse cross section the body portion of the paddle shaped sheet is concurrently deformed into a like transverse cross section. The deformed body portion when held in front of the face permits pressurized hair spray to be discharged onto the hair of the user without danger of the spray contacting the user's facial make up.

2 Claims, 4 Drawing Figures

MAKE UP GUARD

BACKGROUND OF THE INVENTION

1. Field of the Invention

Make up guard.

2. Description of the Prior Art

In recent years the use of pressurized hair spray or pump type dispensers in suitable disposable dispensers has increased substantially in popularity. However, such pressurized hair spray has the disadvantage that unless the dispenser is handled carefully, a portion of the spray may be inadvertently directed onto the facial make up of a woman with detrimental results.

A primary object in devising the present invention is to supply a make up guard that has an extremely simple structure, is transparent, and may be rolled circumferentially about a dispenser without obliterating the label thereon.

Another object of the invention is to furnish a make up guard which due to the low cost thereof may be included as a premium when a dispenser of aerosol or pump type hair spray is purchased.

SUMMARY OF THE INVENTION

A sheet of transparent polymerized resin in the general form of a paddle that has a body portion and an elongate handle. Score lines are formed in the sheet to delineate elongate side areas on the body and handle, with these areas on each side of the sheet merging into a generally trapezoidal shaped intermediate area.

The scored sheet prior to being used as a guard may be wrapped circumferentially about a cylindrical container in which an aerosol or pump type hair spray is dispensed. The purchaser of such a container removes the sheet therefrom, and thereafter presses the longtudinal sides of the handle towards one another to deform the handle to have a generally channel shaped transverse cross section. Such deformation of the handle results in like deformation of the body portion of the paddle shaped sheet. The sheet when so temporarily deformed has substantial longitudinal rigidity and may be disposed adjacent the face of a woman to protect her make up being contacted by hair spray as the latter is dispensed from a container. The sheet material forming the guard must have sufficient memory to return to a generally flat configuration after pressure is released from the longitudinal sides of the handle defining portion of the sheet. The guard is preferably cut from a sheet of plastic material transverse to the rolled grain thereof.

DESCRIPTION OF THE PREFERRED EMBODIMENT

Figure 1:
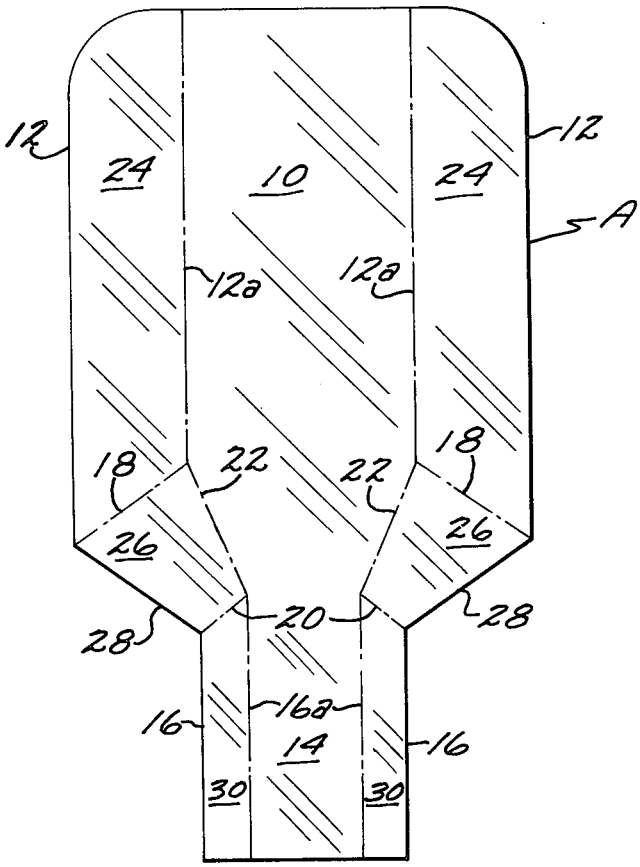
FIG. 1 is a top plan view of the make up guard that is formed from a scored sheet of a resilient polymerized resin that is in the general shape of a paddle.
Figure 2:
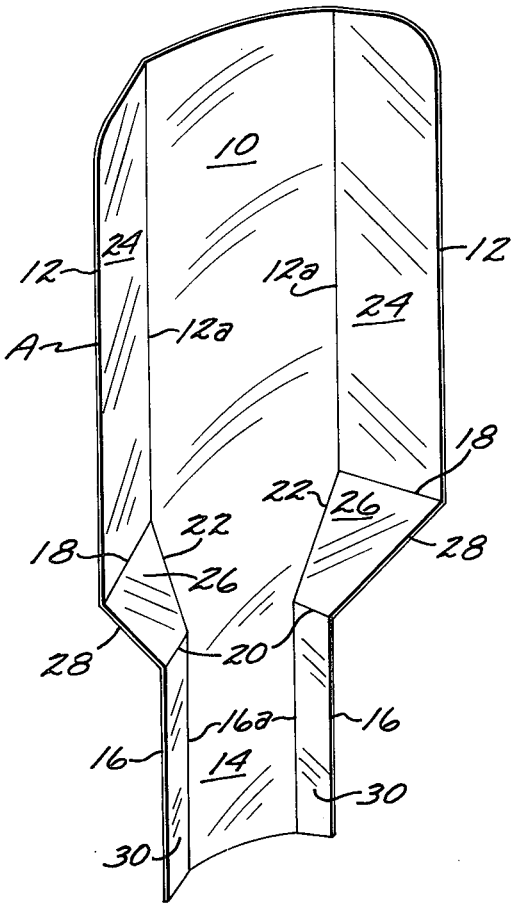
FIG. 2 is a front elevational view of the sheet shown in FIG. 1 after the latter has been transversely deformed to define the make up guard.
Figure 3:
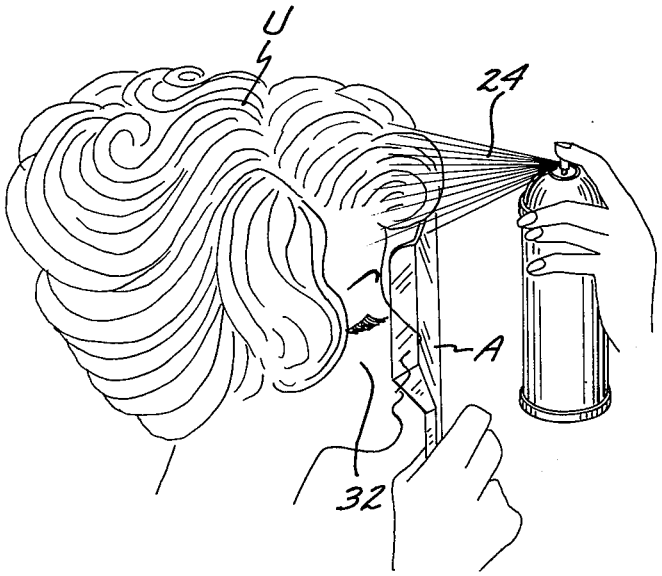
FIG. 3 is a perspective view of a user with the guard in a facial make up protecting position.

The make up guard A as may best be seen in FIGS. 1 and 2 is formed from a sheet of a resilient polymerized resin that may be temporarily deformed transversely, but which resin has sufficient memory that the sheet will return to a substantially flat configuration when no force is applied thereto.

The sheet of polymerized resin is in the general shape of a paddle and includes a body portion 10 having larerally spaced longitudinal sides 12. Body portion 10 has an elongate handle 14 projecting from a central end portion thereof. Handle 14 is substantially narrower in width than body portion 10. The handle 14 has two laterally spaced longitudinal edges 16.

Two score lines 12*a* are formed in body 10 inwardly from edges 12. Score lines 16*a* are also formed in handle 14 inwardly from edges 16. The pairs of score lines 12*a* terminate in a pair of transverse score lines 18, which transverse score lines extend outwardly to the edges 12.

The pair of score lines 16*a* terminate on the upper ends in a pair of score lines 20 that extend outwardly to the edges 16. The pairs of score lines 18 and 20 are connected by score lines 22 that taper towards one another. Score lines 12*a* and edges 12 cooperate to define first elongate flanges 24 that on their lower portions merge into trapezoidal shaped areas 26. Each trapezoidal area 26 is defined by score lines 18, 20 and 22 and an outer edge 28. The edges 16 and score lines 16*a* below areas 26 define two second elongate flanges 30.

When the handle 14 is grasped by a user U and an inwardly directed force is exerted on edges 16 the handle is transversely deformed to a general channel shaped transverse cross section. The deformation of handle 14 results in deforming forces being transmitted through areas 26 to first flanges 24. The first flanges 24 are now angularly disposed relative to the balance of body 10 as shown in FIG. 2, with the sheet having substantial longitudinal rigidity as a result thereof. The deformed body 10 may now be disposed adjacent to the face 32 of user U to protect the face from inadvertent contact with a pressurized spray 34 of material discharged from a cylindrical container 36 that may be of the aerosol or pump type.

Figure 4:
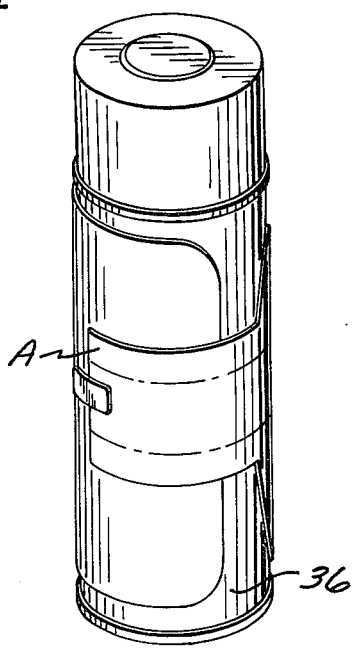
FIG. 4 is a perspective view of an aerosol or pump type hair spray holding container with the sheet that defines the guard disposed in a circumferentially extending position thereon.

In FIG. 4 the make up protector A is illustrated as being wound circumferentially about the container 36. Due to the transparency of the protector A, the make up protector does not obscure the label mounted on the container 36. The protector A is held on container 36 by conventional means such as a pressure sensitive adhesive, rubber band or the like. When pressure is released from edges 16, the sheet defining the protector A will return to substantially flat configuration.

The use and operation of the invention has been explained previously in detail and need not be repeated.

We claim:

1. A make up guard for protecting the face of a user from hair spray, said guard when not in use being capable of selectively occupying either a flat configuration or coiled configuration in which it may be wound about a container holding an aerosol type hair spray without obscuring the label on said container, said guard including:

a generally paddle shaped sheet of a resilient polymerized transparent resin that includes a rectangular body portion from which an elongate rectangular handle of narrower width projects, said body portion and handle having laterally spaced pairs of first and second longitudinal edges, said first and second pairs of edges at their adjacents ends being connected by oppositely tapered edges, and first and second pairs of core lines formed in said sheet inwardly from said first and second edges and cooperating therewith to define first and second pairs of elongate flanges therebetween, with said sheet intermediate said flanges having a plurality of score lines therein that cooperate with said pair of tapered edges to define two generally trapezoidal laterally spaced areas on said sheet, and said pair of longitudinal edges when grasped and forced inwardly towards one another resulting in said second pairs of flanges being angularly disposed relative to the balance of said handle and said handle having a generally channel shaped transverse cross section, said handle when so deforming stressing said body portion through said trapezoidal shaped areas that said first flanges are angularly disposed relative to the balance of said body portion to have said body portion assume a channel shaped transverse cross section, said sheet when said handle and body portion are deformed to said transverse channel shaped cross section having substantial longitudinal rigidity to permit said sheet to be adjacently disposed to the face of a user to act as a make up guard when hair spray is being discharged onto the hair of said user and said resilient polymerized resin defining said sheet having a sufficiently good memory that said sheet returns to a substantially flat configuration when exertion of said force on said longitudinal edges is terminated.

2. A make up guard in the form of an elongate paddle shaped sheet of resilient polymerized resin capable of being wrapped transversely about a cylindrical container of pressurized hair spray, said sheet including a body portion and an elongate handle of narrower width extending therefrom, with said handle when temporarily deformed to have a transverse channel shaped section so stressing said body portion to have a like channel shaped transverse cross section, said sheet when so deformed having substantial longitudinal rigidity and capable of being used as a make up guard substantially parallel to the face of a user to prevent hair spray from said container contacting the face of said user.

* * * * *